US007322403B2

(12) United States Patent
Agee

(10) Patent No.: US 7,322,403 B2
(45) Date of Patent: Jan. 29, 2008

(54) HEAT EXCHANGER WITH MODIFIED TUBE SURFACE FEATURE

(75) Inventor: Keith D. Agee, Torrance, CA (US)

(73) Assignee: Honeywell International, Inc., Morristown, NJ (US)

( * ) Notice: Subject to any disclaimer, the term of this patent is extended or adjusted under 35 U.S.C. 154(b) by 128 days.

(21) Appl. No.: 11/287,665

(22) Filed: Nov. 28, 2005

(65) Prior Publication Data

US 2007/0119576 A1 May 31, 2007

(51) Int. Cl.
*F28F 1/14* (2006.01)

(52) U.S. Cl. ..... 165/109.1; 165/184; 165/159

(58) Field of Classification Search ..... 165/109.1, 165/184, 157–159, 173
See application file for complete search history.

(56) References Cited

U.S. PATENT DOCUMENTS

| | | | | |
|---|---|---|---|---|
| 1,748,140 | A * | 2/1930 | Muhleisen | 165/184 |
| 2,615,686 | A * | 10/1952 | Davidson | 165/117 |
| 3,180,405 | A * | 4/1965 | Hinde | 165/117 |
| 3,603,383 | A * | 9/1971 | Michael et al. | 165/158 |
| 3,976,126 | A * | 8/1976 | Ruff | 165/110 |
| 4,655,282 | A * | 4/1987 | Roffelsen | 165/184 |
| 5,497,824 | A * | 3/1996 | Rouf | 165/184 |
| 6,543,529 | B2 * | 4/2003 | Ohgaki | 165/171 |
| 6,920,918 | B2 * | 7/2005 | Knecht et al. | 165/157 |
| 2005/0098307 | A1 | 5/2005 | Goto | |

FOREIGN PATENT DOCUMENTS

| | | |
|---|---|---|
| EP | 0031866 | 8/1980 |
| FR | 2551193 | 7/1984 |
| WO | WO2005040708 | 5/2005 |

OTHER PUBLICATIONS

PCTISR, PC, Apr. 17, 2007, Honeywell.

* cited by examiner

*Primary Examiner*—Teresa J. Walberg
(74) *Attorney, Agent, or Firm*—Chris James; Grant Langton

(57) ABSTRACT

A heat exchanger includes a shell that has an inner chamber defined by an inside wall surface. A tube stack disposed within the inner chamber and includes a plurality of flat elongated tubes that define a first fluid flow path. The tubes each include a wire that is wound around a tube outside surface and that extends in a helical manner along a tube length. When stacked together, the wires of adjacent tubes connect with one another to form an "X" pattern connection that operates to both distance the adjacent tubes and form a second fluid flow path along the outside surfaces of the tubes. The connection between the wires causes turbulent flow in the coolant that improves the heat transfer characteristic of the coolant, and the connection between the wires provides structural support to the tubes in the tube stack to help reduce vibration induced heat exchanger failures.

18 Claims, 8 Drawing Sheets

*Fig. 1*- Prior Art

*Fig.* 2-Prior Art

*Fig. 3*-Prior Art

HEAT EXCHANGER WITH MODIFIED TUBE SURFACE FEATURE

FIELD OF INVENTION

This invention relates generally to the field of heat exchangers and, more particularly, to heat exchangers having a plurality of stacked tubes within a surrounding shell, wherein the tubes are configured including a flow element to provide an outside surface feature that produces both a desired spacing between the tubes and that causes a desired turbulation of flow along the tube surface.

BACKGROUND OF THE INVENTION

The present invention relates to heat exchangers that are generally configured comprising a number of internal fluid or gas passages disposed within a surrounding body. In an example embodiment, the internal passages are designed to accommodate passage of a particular fluid or gas in need of cooling, and the body is configured to accommodate passage of a particular coolant, cooling fluid or gas used to reduce the temperature of the fluid or gas in the internal passages by heat transfer through the structure of the internal passages. A specific example of such a heat exchanger is one referred to as a shell and tube exchanger, which can be used in such applications as exhaust gas cooling for internal combustion engines.

Referring to FIG. 1, a shell and tube heat exchanger 10 generally includes a tube bundle 12 formed from a plurality of individual tubes 14, i.e., internal passages, that are aligned together, positioned next to one another, and that have one or both openings at the tube ends 16 positioned adjacent one another. The tube bundle 12 is disposed within a surrounding shell 18.

The shell is configured having an inlet 20 and outlet 22 to facilitate the passage of the coolant into and out of the shell. Referring now to FIG. 2, in a single-pass shell and tube heat exchanger, the tube bundle 12 is configured so that the tube ends 16 pass through or are positioned adjacent respective ends 24 of the shell. In a dual or multi-pass shell and tube heat exchanger, the tube bundle is configured having one or more 180-degree bends at one of the tube ends to facilitate passage through the shell more than one time.

Referring back to FIG. 1, a tank or manifold 26 is attached to each end of the shell 18 and each serves to direct the flow of fluid or gas into and out of the tube bundle. Referring to FIG. 2 again, a header or tube plate 28 can be attached to the tube bundle adjacent one or more of the tube bundle ends 16 to form a connection or attachment point between the tubes in the tube bundle and/or between the tube bundle and a respective end of the shell. As best shown in FIG. 3, the header plate 28 serves to connect the individual tubes 14 in the bundle together, connect the tube bundle to the shell 18, and provides a seal between the shell and the tube bundle so that coolant within the shell does not escape. The tank or manifold is typically attached by weld to the header plate to provide a fluid-tight transfer of fluid or gas from the tube bundle.

In a shell and tube heat exchanger configured for use in exhaust gas cooling, exhaust gas is passed through the plurality of tubes within the tube bundle for cooling by use of a coolant such as water that is passed through the shell, and thus placed into contact with the outside surfaces of the tube bundle tubes. In an effort to increase the heat transfer capability of such shell and tube heat exchangers, the outside surface of the tubes within the tube bundle are sometimes configured with fins extending therefrom. A fin is understood to be any extended surface contacting the tube for the purpose of improving heat transfer. For example, for flat tube heat exchangers, the fins may be separate pieces that are sandwiched between the tubes.

While the presence of such fins can operate to improve the heat transfer characteristics of the tubes, they can also operate to trap debris flowing within the coolant that can cause an unwanted pressure drop of the coolant through the heat exchanger. Such unwanted coolant flow restriction through the heat exchanger can cause the coolant, when provided in the form of a liquid, to boil and thereby further reduce the heat transfer capability of the heat exchanger.

It is, therefore, desired that a heat exchanger be constructed in a manner that provides improved heat transfer performance without the unwanted potential for trapping debris on the cooling side that can produce an unwanted pressure drop therein. If is further desired that the hear exchanger be constructed in a manner that produces a desired turbulation of the cooling medium, to thereby improve heat transfer within the heat exchanger. It is further desired that the heat exchanger be constructed in a manner that provides a contact surface among adjacent tubes within the tube bundle to produce improved structural support to protect against damage that can be caused to the tubes within the tube bundle or tube stack by vibration loads. It is still further desired that such heat exchangers be constructed using materials and methods that are readily available to facilitate cost effective manufacturing and assembly of the same.

SUMMARY OF THE INVENTION

A heat exchanger constructed in accordance with principles of this invention generally comprises a shell having an inner chamber that is defined by an inside wall surface. In an example embodiment, the shell is formed having a one-piece configuration made from a single piece of material. A tube stack or core is disposed within the inner chamber of the shell and comprises a plurality of tubes that are arranged in a stacked together configuration. In an example embodiment, the tubes are formed from a single piece of material. A first gas or fluid flow path of the heat exchanger is defined within the tubes. If desired, the tubes can include a flow element disposed therein to create more than one first gas or fluid flow path within the tube.

The tubes have an outside surface comprising an element projecting outwardly therefrom. The element extends along the tube outside surface in a helical pattern along a length of the tube. In an example embodiment, the element is in the form of a wire that is wrapped around each tube. In an example embodiment, the wire has a pitch of between about 30 to 90 degrees, and preferably between about 45 to 60 degrees, relative to an axis of the tubes. In an example embodiment, the wire has a thickness and projects a distance from the tube outer surface in the range of from about 0.5 mm to 2 mm.

When assembled together in a stacked configuration, that wires of adjacent tubes contact one another to distance the adjacent tubes apart from one another and form a second gas or fluid flow path across the outer surfaces of adjacent tubes. The presence of the wires and the connection between the wires of adjacent tubes is desirable in that they operate to provide turbulence within the coolant flow that improves the heat transfer characteristic of the coolant, and reduces the potential for coolant boiling. Further, the presence of the wires and the connection provided thereby provides structural support among the tubes within the heat exchanger to eliminate unwanted vibration of the tubes relative to one another, thereby operating to help reduce vibration induced heat exchanger failures.

BRIEF DESCRIPTION OF THE DRAWINGS

The invention will be more clearly understood with reference to the following drawings wherein.

DETAILED DESCRIPTION OF THE INVENTION

The present invention relates to heat exchangers used for reducing the temperature of an entering gas or fluid stream. A particular application for the heat exchangers of this invention is with vehicles and, more particularly, is to cool an exhaust gas stream from an internal combustion engine. However, it will be readily understood by those skilled in the relevant technical field that the heat exchanger configurations of the present invention described herein can be used in a variety of different applications.

Generally, the invention constructed in accordance with the principles of this invention, comprises a heat exchanger including a stack of elongated, flattened tubes that are enclosed in a surrounding shell. The shells each have an outer surface that is wrapped with a wire or the like in a manner such that when arranged adjacent one another to form the tube stack, the wires around the outside surface of adjacent tubes contact one another, operating to distance the tubes apart, form a turbulation source for the coolant passing between the tubes, and provide structural support for the tubes.

Figure 1:
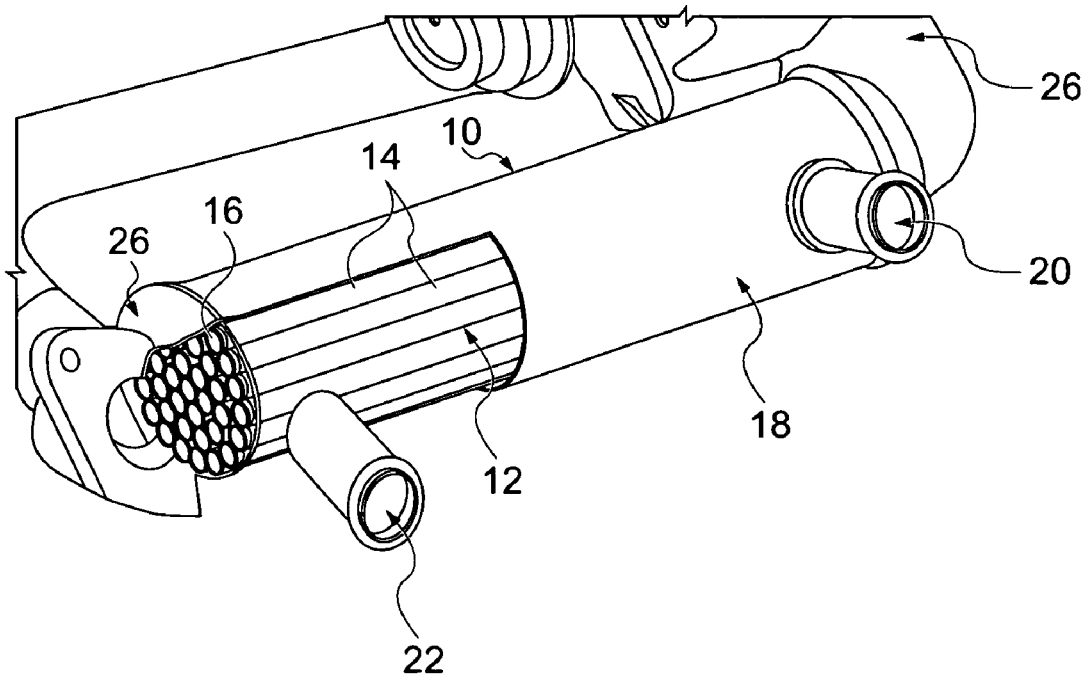
FIG. 1 is a perspective view of a prior art shell and tube heat exchanger.
Figure 2:
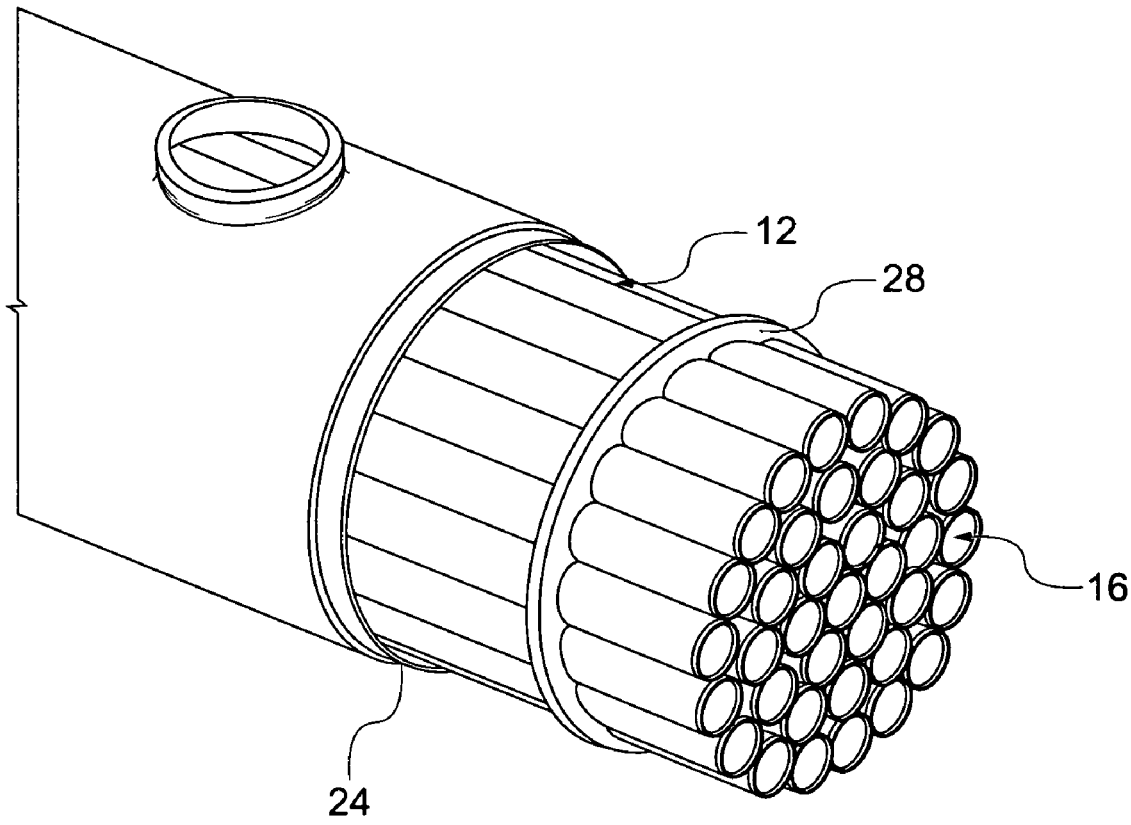
FIG. 2 is a perspective view of the prior art heat exchanger of FIG. 1, illustrating placement of a tube bundle within a shell.
Figure 3:
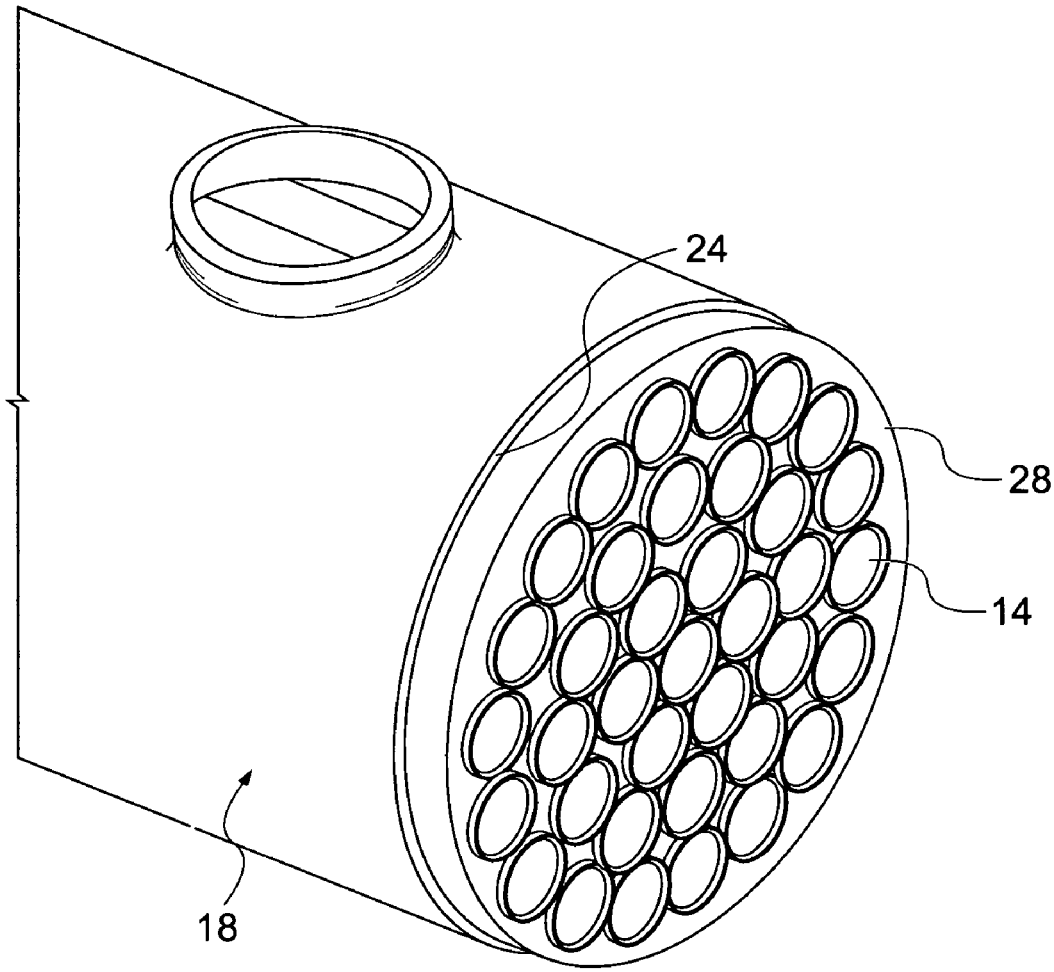
FIG. 3 is a perspective view of the prior art heat exchanger of FIGS. 1 and 2, illustrating the tube bundle as attached to the shell.
Figure 4:
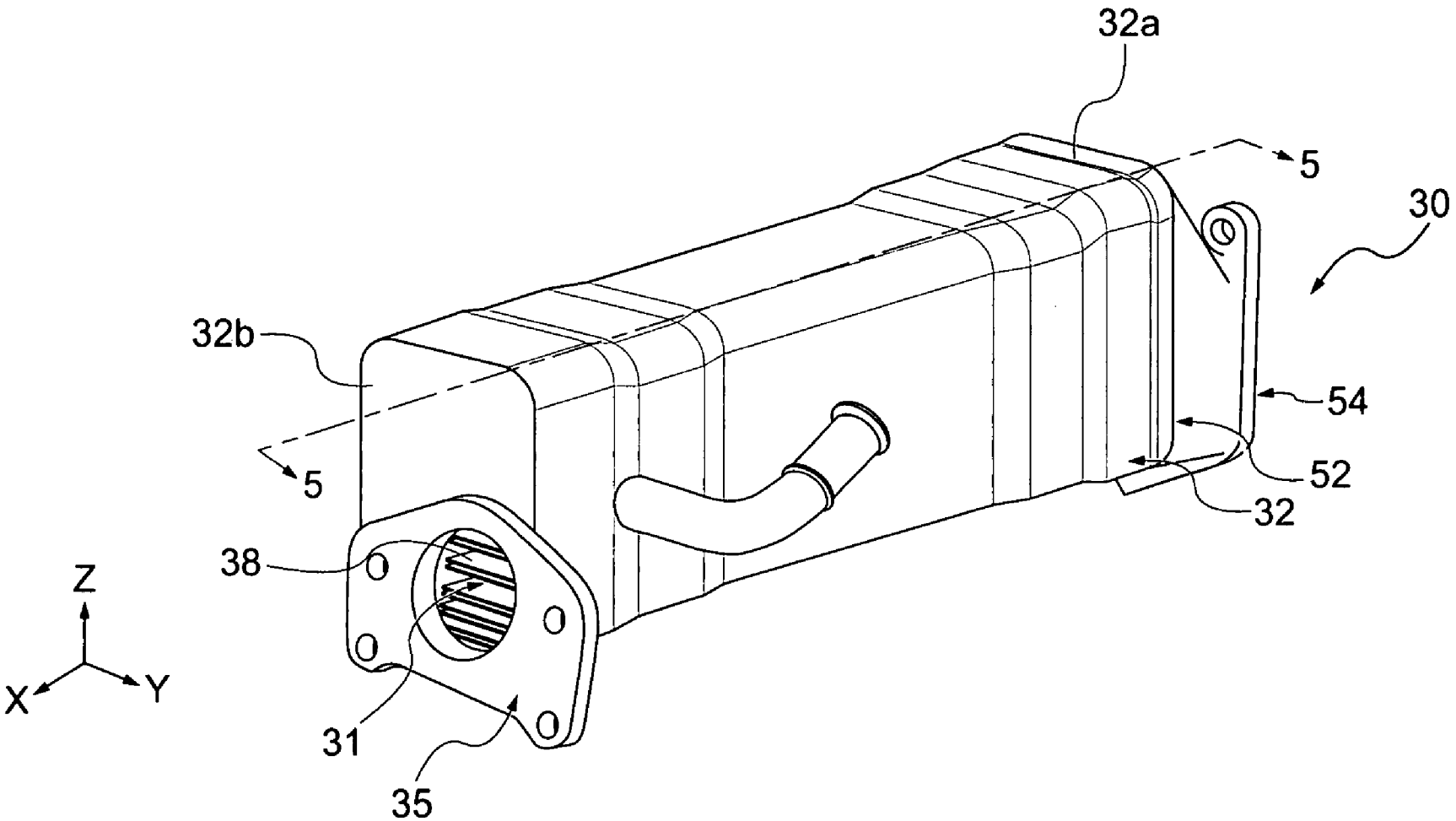
FIG. 4 is a perspective view of a heat exchanger of this invention illustrating the shell and a tube stack in an assembled state.
Figure 5:
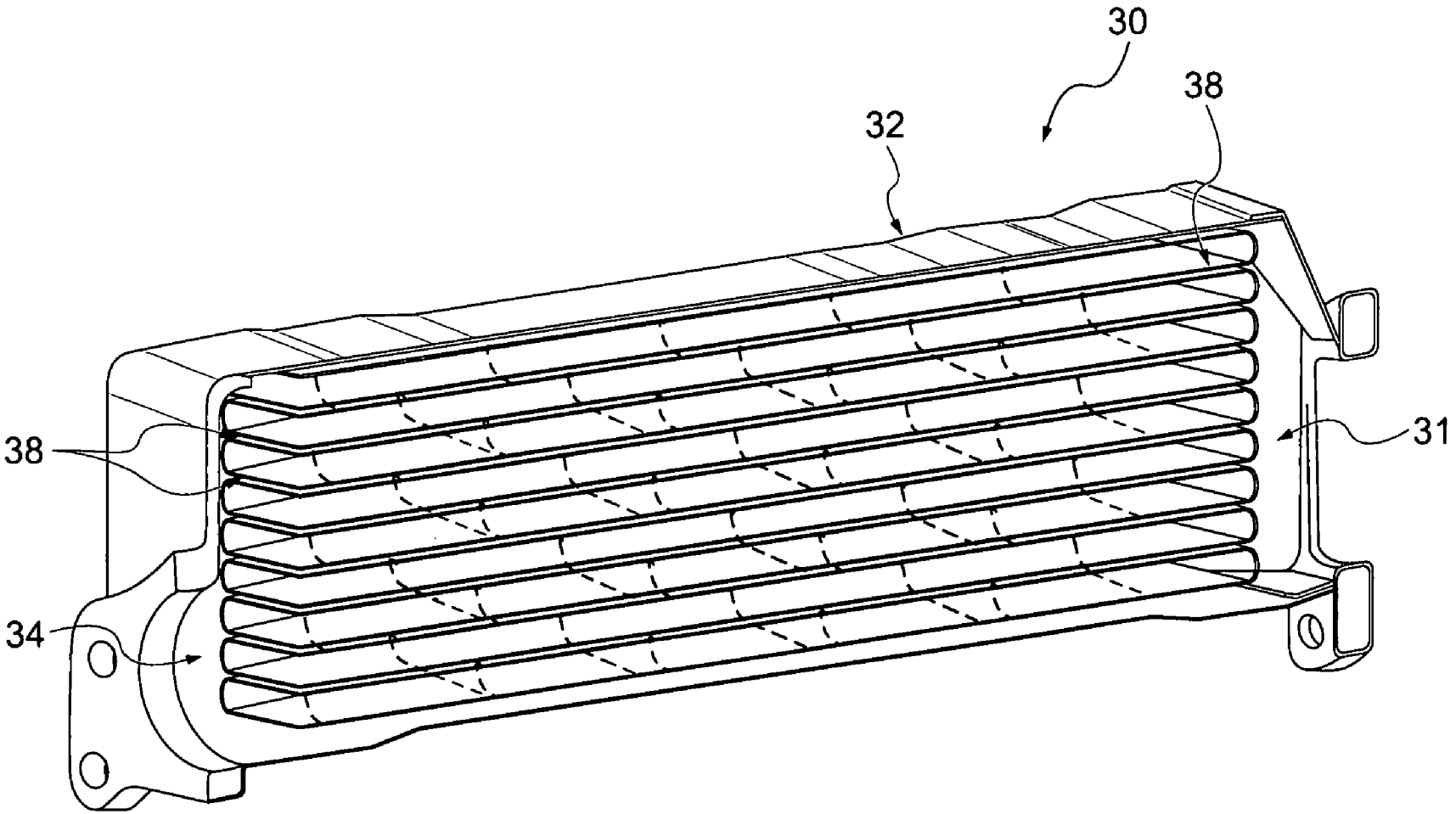
FIG. 5 is a cross-sectional view of the heat exchanger of FIG. 4 taken along line 5—5 of FIG. 4.
Figure 8:
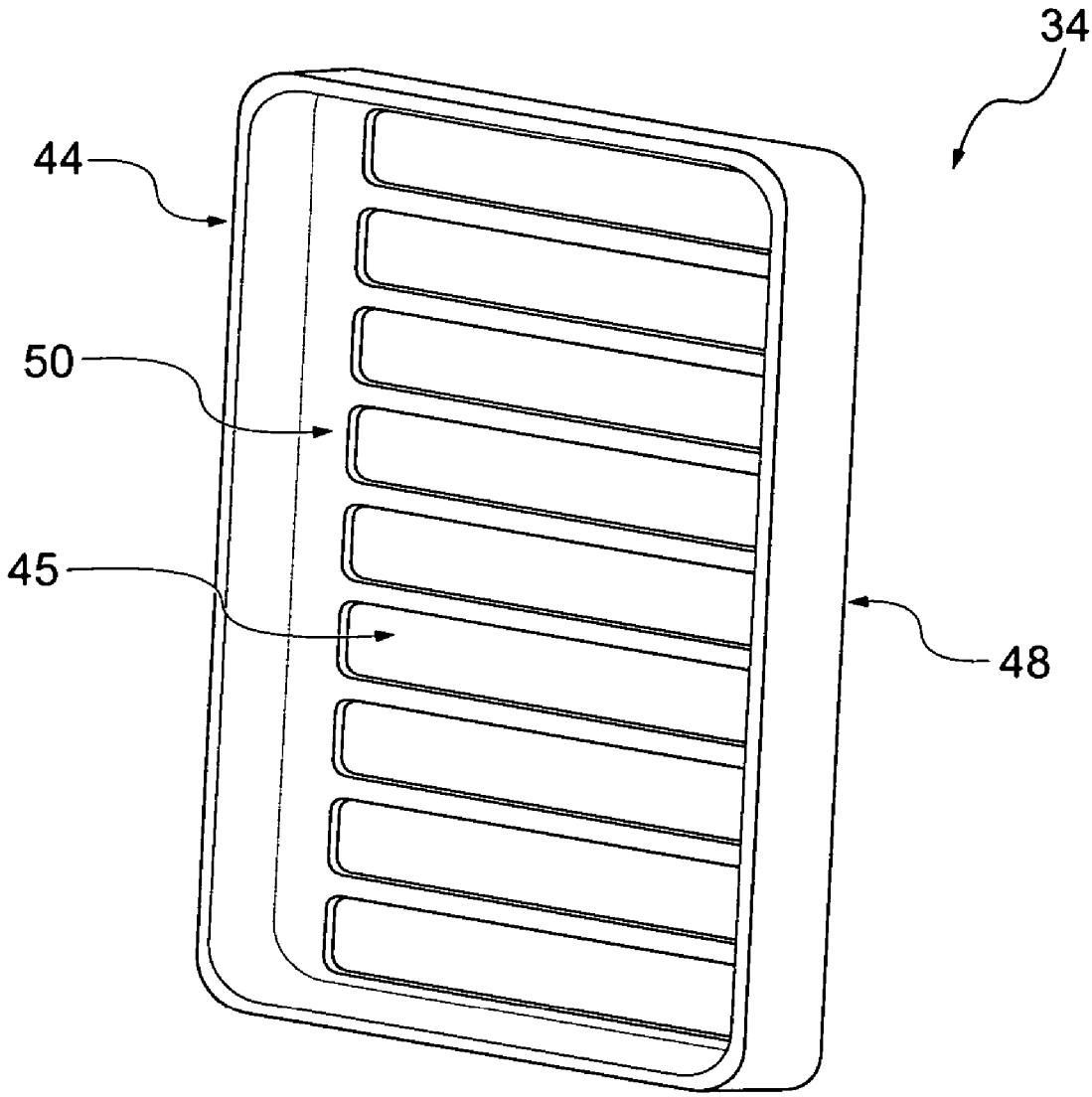
FIG. 8 is a perspective view of a header plate, in accordance with the invention.

FIG. 4 illustrates a perspective view of a heat exchanger 30 of this invention, and FIG. 5 illustrates a sectional view of the heat exchanger taken along line 5—5 of FIG. 4. The heat exchanger 30 comprises a tube stack 31, formed from a plurality of elongated and flattened tubes 38 that are each arranged in a stack, which stack is disposed within the shell 32. A header plate 34 (as best shown in FIG. 8) is positioned adjacent both ends of the tube stack 31, and operates to connect the tubes 38 together adjacent the tube ends, seals the tubes 38 from the coolant, and as better described below provides a structure for connecting the tube stack 31 to the shell 32.

In an example embodiment, the shell 32 is configured to surround the tube stack and includes a coolant inlet and a coolant outlet to facilitate passage of a desired cooling fluid or medium therethrough. The shell can be formed from suitable structural materials such as metals, metal alloys, and the like having desired structural and mechanical properties enabling use in such a heat exchanger application. In a preferred embodiment, the shell is formed of a single piece of material. In a preferred embodiment, the shell 32 is made from a stainless steel material. The shell can be made by molding process or the like. In a preferred embodiment, the shell is made by hydroforming or end expanding a seam welded rectangular tube.

In an example embodiment, the shell 32 is configured having a geometry that both surrounds the tube stack and that facilitates a desired degree of coolant circulation therein to provide a desired degree of heat transfer contact with the tube stack. In the example embodiment illustrated in FIGS. 4 and 5, the shell is configured having a generally rectangular cross-sectional geometry, and includes an inlet end 32*a* at one end of the shell, and an outlet end 32*b* at an opposite end of the shell. As shown in FIG. 4, the outlet end 32*b* includes a flange that is attached thereto for the purpose of connecting the heat exchanger to a further connection device or system element, e.g., a portion of an exhaust gas handling system.

Figure 6:
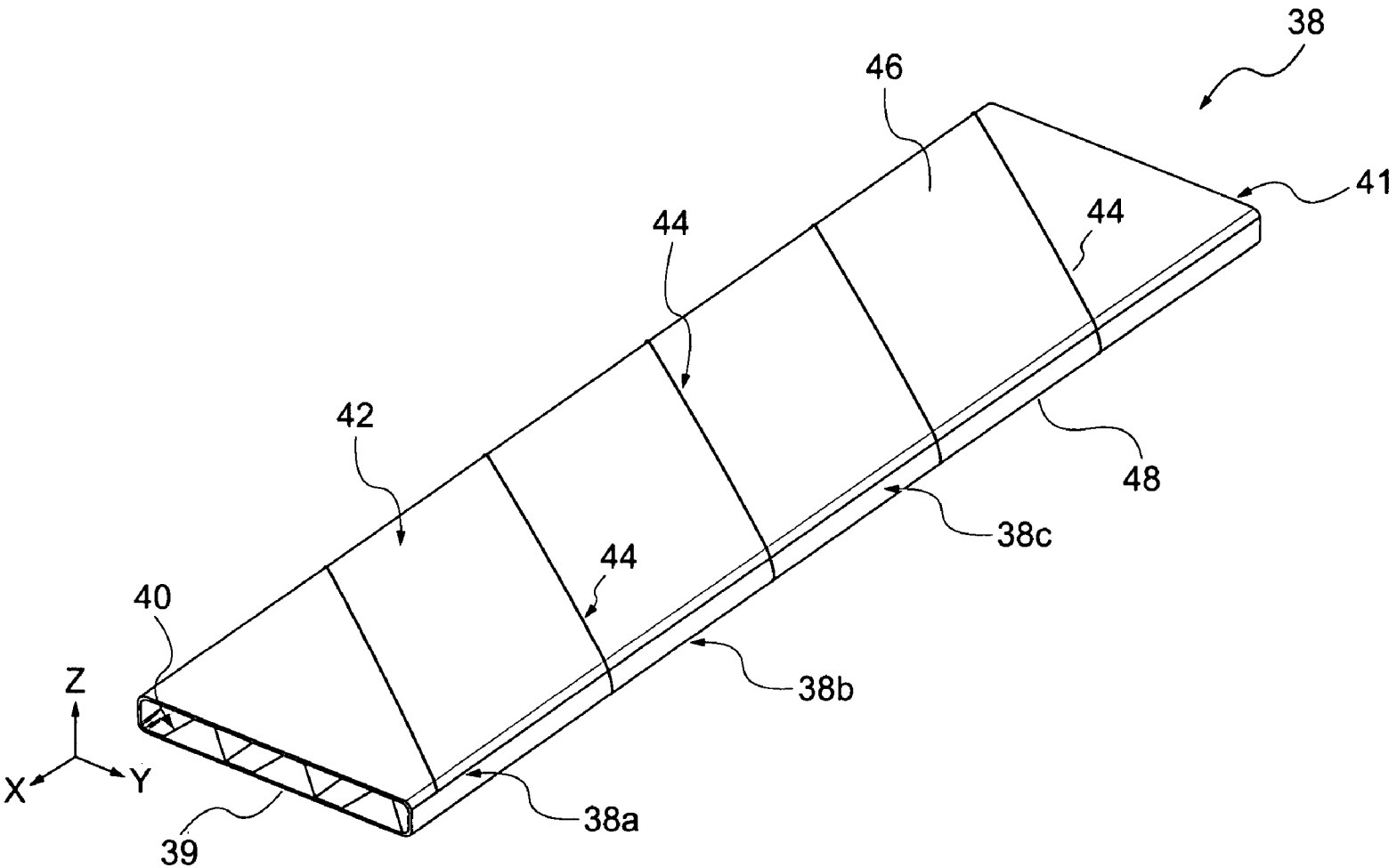
FIG. 6 is a perspective view of a tube taken from the tube stack.

As is shown in FIG. 5, the tube stack 31 comprises a plurality of individual tubes 38 that are arranged in combination with one another, and that each have a generally flatted and elongate configuration. In an example embodiment, the tubes 38 are stacked on top of one another. As best shown in FIG. 6, each tube 38 is formed from a single sheet of material and has a pair of edges 38*a* and 38*b* that extend longitudinally along a length of the tube running between tube ends 39 and 41. In an example embodiment, the tubes are roll formed by bending the sheet of metal into a desired configuration. In a preferred embodiment, the tube is formed by bending the metal sheet about itself to provide central passage defined by a wall structure configuration that having a generally rectangular or flattened oval cross section.

During the process of forming the tube, the edges 38*a* and 38*b* are positioned adjacent or abutting one other, and are attached to each other to form a seam 38*c* that runs lengthwise along the tube. In a preferred embodiment the tube will be formed in a high speed tube rolling mill (10-100 m/min speed). The tube edges 38*a* and 38*b* are joined to one another by bonding process such as by brazing, welding or the like, and in a preferred embodiment can be attached by TIG or high frequency welding, or can be attached without a welded joint by brazing together.

Figure 7:
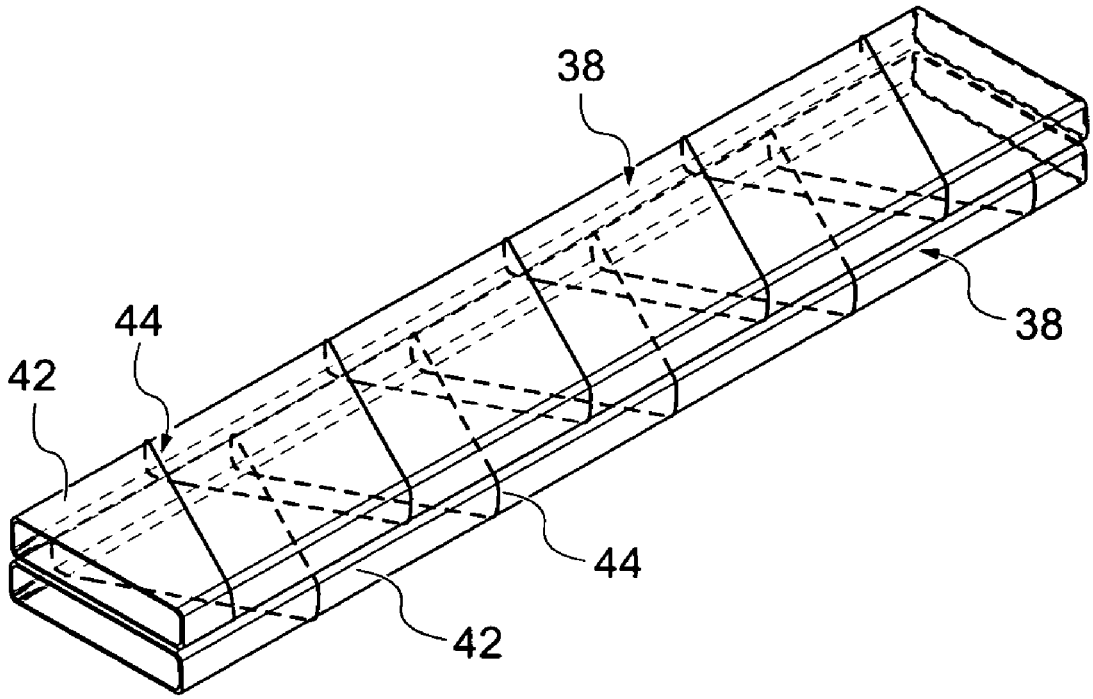
FIG. 7 is a perspective view of two adjacent tubes in the tube stack.

A feature of this invention is the formation of the tubes from a single sheet of material, thereby providing a tube having essentially a one-piece constriction. Such method of tube fabrication makes the tubes 38 easy to manufacture and durable for high performance applications, e.g., the single seam attachment operates to minimize any potential leak points in the tube to one. As illustrated in FIG. 6 and 7, an example embodiment of the heat exchanger can include tubes 38 that are constructed having a flow element 40 disposed therein (as best shown in FIG. 6).

The flow element 40 can be provided in the form of a corrugated member or the like that extends a partial or complete length of the tube. The flow element 40 can be referred to as a fin or a turbulator, and can form a further flow path 46 within the tube, operate to increase the gas or fluid contact surface area within the tube, and operate to increase flow turbulence therein, which can aid in cooling the fluid flowing through the tubes 38. Additionally, the fin or turbulator can function to add structural rigidity to the tube if desired.

As shown in FIGS. 6 and 7, the tubes 38 are configured each having an outside surface or surfaces 42 that includes an element 44 that is wrapped therearound and that extends a distance outwardly therefrom. In an example embodiment, the element is provided in the form of a winding that extends in a helical or spiral fashion around the outside surface of the tube. The winding can be integral with the tube, e.g., can be rolled or stamped into the sheet used to form the tube, or can be provided in the form of a separate element.

In an example embodiment, the winding is provided in the form of a wire that is wrapped around the outside surface of the tube, and that extends between the tube axial ends. The wire in such embodiment can be formed from an appropriate material that is capable of being wound around the tube and maintaining its placement and form under the operating conditions of the heat exchanger. In an example embodiment, the wire is formed from a metallic material in the form of a metal or metal alloy. In a preferred embodiment where the tube is formed from stainless steel the wire is formed from stainless steel. For lower temperature heat exchangers, other materials such as aluminum, copper, or mild steel may be used. The material that is used to form the wire can be the same or different from that used to form the tubes. In an example embodiment, the tube and wire are formed from the same material.

The element 44 is wrapped completely around the outside surface of each tube, thus passing over both opposed primary outside surfaces 46 and 48 of the tube, which surfaces are positioned adjacent the primary surfaces of other tubes forming the tube bundle. As best illustrated in FIG. 7, when the tubes comprising the elements 44 are stacked on top of one another, the element of one tube contacts and crosses the element of an adjacent tube, which contact serves several functions.

First, such contact operates to distance the two adjacent tubes apart from one another, thereby forming a fluid flow path therebetween. Accordingly, the thickness of the element, or the distance that the element projects outwardly from a tube, defines approximately one half of the coolant passage height between adjacent tubes within the tube bundle and heat exchanger.

Second, such contact between the adjacent elements 44 operates to trip a boundary extending along the tube surface, thereby turbulating the flow of the coolant being passed thereover. Turbulating or causing turbulence in the coolant flow within the heat exchanger operates to increase the heat transfer coefficient on the coolant side of the tubes, and reduces the surface temperature along the tubes to help prevent any unwanted boiling of the coolant. Third, the contact provided between the elements provides a contact surface among all of the tubes in the tube bundle, providing structural support to the tube bundle against vibration loads, thereby operating to help reduce vibration induced heat exchanger failures.

The wire is tacked or otherwise attached to outside surface of the tube. The wire can be attached by welding or brazing process, and can be attached along the entire length or just at the ends, depending on the particular embodiment. In a preferred embodiment, the wire is attached to the tube along the entire length by brazing.

The pitch of wrapping can and will vary depending on the particular end use application. For example, the pitch of the wrapping may vary from approaching 90 degrees to the tube axis to about 30 degrees, In an example embodiment, a wrapping pitch in the range of from about 45 to 60 degree is desired so that any debris in the coolant is easily passed, while still providing adequate turbulation and support. The exact pitch that is used for the element will depend on such factors as: the heat transfer characteristics of the fluids or gases being passed through the tubes, the coolant being passed over the tube bundle, and the materials selected for forming the tubes; the desired pressure drop within the coolant side of the heat exchanger; and the boiling requirements or temperature of the cooling medium.

Generally speaking, configuring the element with a shorter pitch will improve heat transfer and reduce the probability of coolant boiling, but at the expense of an added pressure drop, while configuring the element with a longer pitch will reduce the pressure drop of the coolant flow but at the expense of reduced heat transfer and increased probability of coolant boiling. Accordingly, it is to be understood that the element pitch reflects a compromise of properties that will likely be unique to each individual heat exchanger application. The pitch can be constant or can be variable along a tube depending on the particular characteristics desired for the heat exchanger. In a preferred embodiment, the pitch of the element is constant.

In an example embodiment, for purpose of improving manufacturing efficiency, all of the tubes are constructed having the element configured in the same manner. When used to form the tube bundle, the adjacent tubes are merely turned over so that the primary surface of the adjacent tubes are opposed from one another, or are not the same, thereby facilitating formation of the cross or "X" pattern between the contacting elements of the opposed tube surfaces (as best shown in FIG. 7).

The elements 44 can be configured having a number of shapes, e.g., having a round, square, constant, tapered or offsetting cross-sections. In an example embodiment, where the elements are provided as a wire, the wire is constructed having a round or circular cross-sectional configuration.

The element can extend a predetermined distance from the tube outside surface, which distance can vary depending on a number of factors such as the type of coolant being passed through the shell, the desired flow rate or residence time for the coolant, and the like. In an example embodiment, where the element is provided in the form of a metal wire, it has a thickness in the range of from about 0.5 to 2 millimeters, and more preferably about 1 millimeter, depending on the desired degree or extent of tube separation. In an example embodiment, wherein the tubes are sized having a length of from about 110 mm to 720 mm, and a width extending between the lengthwise edges of in the range of from about 40 mm to 120 mm, the elements are sized to extend a distance from the outer surface approximately 1 mm.

As shown in FIG. 7, adjacent tubes 38 are preferably arranged and oriented with one another so that when they are placed in a stacked position, the elements 44 of adjacent tubes 38 make contact with one another to form a crossed or "X" pattern. This arrangement of adjacent tubes within the stack having adjacent elements in contact with one another operates define a plurality of spaces or channels between the outside surface of adjacent tubes to define and direct the passage of the coolant therethrough. As noted above, the elements 44 can be oriented along the tube surface in a manner that gives rise to a plurality of coolant passages that are configured to influence the passage of coolant through the tube stack in a manner that improves thermal transfer within the heat exchanger.

The elements 44 of the adjacent tubes can be brazed or welded together in the tube stack. Alternatively, the elements of the adjacent tubes can just be in contact with another without being bonded together.

As noted above, the elements 44 disposed along the tube surfaces provide a number of advantages. First, they provide pressure containment, operating to lower the gas and coolant pressure stresses in the exchanger 30. Second, they provide spacing between the tubes 38, allowing fluid (typically coolant) to flow therebetween As shown in FIGS. 5 and 8, header plates 34 are disposed within the heat exchanger and are configured having inside surface features extend around respective opposed ends of the tube stack 31, and having an outside surface that is configured and sized to complement and fit within an inside wall surface of the shell 32. As best illustrated in FIG. 8, the header plate 34 is generally rectangular in shape and includes a number of openings 45 that are configured and sized to accept placement of end portions of the tubes within the tube stack therein.

The header plates 34 are attached to the outside surface of each end of the tube stack 31 during the brazing process. Once the tube stack 31 has been assembled and inserted into the shell 32, the header plates are attached to the inside wall surface of the shell by brazing, welding or the like. Bonding the header plates to the inside wall surface of the shell helps to provide a sealed coolant passage. It will be understood that the tube stack 31 is preferably dimensioned so that it fits tightly into the shell 32. In a preferred embodiment, this tight fit acts as a brazing fixture providing compression force on the tubes 38 to achieve the braze joints in the core stack. This tight fit also helps to prevent/control separation of the tubes caused by expansion during use.

The header plate 34 preferably includes a shoulder 48 that defines a transition between the main body 50 of the header plate 34 comprising the number of openings 45, and an axially projecting section 44. The header plate shoulder 48 and is sized and configured to provide a cooperative nesting fitment within a complementary surface feature of the shell inside wall surface when the tube stack 31 is placed within the shell. If desired, the header plates 34 can also be configured having a self-fixturing or registering means disposed along an outside surface for placing it in a particular position with respect to the shell during assembly and brazing.

Referring back to FIG. 4, after the tube stack 31 has been positioned within the shell 32 and fixedly connected into place as described above, a diffuser 52 is attached to the inlet end 32*a* of the shell 32. The diffuser 52 also includes a flange 54 for connecting the heat exchanger 30 to another device or portion of the cooling system. For example, when placed into use to cool exhaust gas of an internal combustion engine, this flange can be connected to a fluid handling device receiving exhaust gas from the engine. The diffuser can be connected to the shell by conventional attachment methods, such as by welding, brazing or the like. It is to be understood that the use of a diffuser can be optional, and that heat exchanges constructed in accordance with principles of this invention may or may not include a diffuser depending on the particular end use application.

In general, the entire assembly is preferably made of metals and metal alloys, such as stainless steel of the like, and the assembly elements are brazed using a braze material that is compatible with the selected metal or metal allow, e.g., with a nickel-based braze material or the like when the selected material useful for making the heat exchanger elements is stainless steel.

The heat exchanger as constructed in accordance with the principles of this invention functions in the following manner. The desired fluid or gas to be cooled is directed into the heat exchanger via the inlet opening 32*a*, through the diffuser 52 and into and through the plurality of tubes making up the tube stack. Within the tubes, the gas or fluid flows across the fins of any turbulator 40 that is disposed therein, and within the further defined channel or passage 46 therein.

Coolant enters the heat exchanger via a coolant inlet and is placed into contact with the tube shell. As noted above, and as shown in FIG. 7, the assembly of adjacent tubes 38 within the tube stack define the coolant flow paths between and across the adjacent surfaces of the tubes. Thus, the overall coolant flow path within the heat exchanger is generally defined by the inside wall surface of the shell 32, the outside surface of the tubes 38, and the placement position and configuration of the elements 44 along the outside surface of the tubes.

The coolant flow within the heat exchanger operates to reduce the temperature of the gas or fluid being passed through the tube stack via thermal heat transfer, and the cooled gas or fluid exits the heat exchanger via the outlet opening 32*b*. Coolant that has passed through the tube stack exits the heat exchanger via a coolant outlet.

It is to be understood that the embodiments described above and illustrated are but examples of examples embodiments of heat exchangers as constructed according to principles of this invention, and that those skilled in the art will recognize modifications and substitutions to the specific embodiments disclosed herein. Such modifications are within the scope and intent of the present invention.

What is claimed is:

1. A heat exchanger comprising:

a shell having an inner chamber defined by an inside wall surface; and a tube stack disposed within the inner chamber and comprising a plurality of tubes arranged in a stack, the tubes having a substantially rectangular cross-sectional wall structure, wherein a first gas or fluid flow path is defined within the tubes, wherein each tube includes an element extending along an outside surface of the tube in a helical pattern along a length of the tube, and wherein the element on adjacent tubes contact one another to form a cross pattern therebetween and to form a second gas or fluid flow path across the outer surfaces of adjacent tubes.

2. The heat exchanger as recited in claim 1 wherein the tube is formed from a single piece of material.

3. The heat exchanger as recited in claim 1 wherein the element is a wire that is wound around the tube outside surface.

4. The heat exchanger as recited in claim 3 wherein the wire extends from adjacent one axial end of the tube to an opposite axial end of the tube.

5. The heat exchanger as recited in claim 3 wherein the wire is attached to the tube outside surface and has a pitch relative to an axis of the tube of between about 30 to 90 degrees.

6. The heat exchanger as recited in claim 5 wherein the wire has a pitch of between about 45 to 60 degrees.

7. The heat exchanger as recited in claim 1 wherein the shell has a one-piece construction made from a single piece of material.

8. The heat exchanger as recited in claim 1 wherein the elements are arranged along each tube outer surface such that the second fluid flow pat is non linear.

9. The heat exchanger as recited in claim 1 further comprising a flow element disposed within at least one of the tubes that creates more than one first gas or fluid flow path within the tube.

10. The heat exchanger as recited in claim 1 wherein the element projects a distance from the tube outer surface in the range of from about 0.5 mm to 2 mm.

11. A method of making a heat exchanger comprising the steps of assembling a plurality of tubes into a stacked arrangement to form a tube stack, wherein each tube has a substantially rectangular cross-sectional wall structure and includes an outer surface that comprises an element that extends around the outer surface in a helical pattern along a length of the tube, wherein the element on adjacent tubes in the tube stack contact one another to form a cross pattern therebetween and to form a gas or fluid flow passage along outside surfaces of adjacent tubes, and wherein the tubes are secured within the tube stack by a header plate at opposed tube ends;

inserting the tube stack into a shell, wherein the header plate is interposed between the shell and assembly of tubes; and sealing one or more ends of the shell to encase the tube stack therein, and to form a leak tight seal between gas or fluid flowing through the tube stack, and gas or fluid flowing between the tube stack and the shell.

12. The method as recited in claim 11 wherein, prior to the step of assembling, attaching the element onto the tube outer surface so that it has a pitch, as measured from an axis of the tube, of about 30 to 90 degrees.

13. The method as recited in claim 12 wherein during the step of attaching, the element that is used is in the form of a wire that is wound around the outer surface.

14. The method as recited in claim 11 further comprising, before the step of inserting, forming the element, wherein the element extends a distance from the tube outer surface in the range of from about 0.5 mm to 2 mm.

15. A heat exchanger comprising:

a shell having an inner chamber defined by an inside wall surface, the shell including a coolant inlet and a coolant outlet;

a tube stack disposed within the inner chamber and comprising a plurality of flat tubes stacked one on top of one another, wherein a first gas or fluid flow path is defined within the tubes, wherein each tube comprises a wire that is wound around an outer surface of the tube and that extends in a helical pattern axially along the tube, and wherein the wires on adjacent tubes contact one another to form a cross pattern therebetween and distance the outer surfaces of the adjacent tubes from one another and form a second gas or fluid flow path across the outer surfaces of the adjacent tubes;

a fluid or gas inlet attached to one end of the shell and in communication with the first gas or fluid flow path for directing a gas or fluid into the tube stack; and a fluid or gas outlet attached to another end of the shell and in communication with the first gas or fluid flow path for receiving the gas or fluid from the tube stack.

16. The heat exchanger as recited in claim 15 wherein the wire has a pitch relative to an axis of the tube of between about 30 to 90 degrees.

17. The heat exchanger as recited in claim 15 wherein the wire has a pitch of between about 45 to 60 degrees.

18. The heat exchanger as recited in claim 15 wherein the wire extends a distance from the tube outer surface in the range of from about 0.5 mm to 2 mm.

* * * * *